US008177654B2

(12) United States Patent
Pelz

(10) Patent No.: US 8,177,654 B2
(45) Date of Patent: May 15, 2012

(54) GOLF TRAINING SYSTEM

(76) Inventor: David T. Pelz, Austin, TX (US)

( * ) Notice: Subject to any disclaimer, the term of this patent is extended or adjusted under 35 U.S.C. 154(b) by 0 days.

(21) Appl. No.: 12/981,672

(22) Filed: Dec. 30, 2010

(65) Prior Publication Data

US 2011/0159980 A1 Jun. 30, 2011

Related U.S. Application Data

(60) Provisional application No. 61/291,708, filed on Dec. 31, 2009.

(51) Int. Cl.
*A63B 69/36* (2006.01)

(52) U.S. Cl. ..... 473/220; 473/221

(58) Field of Classification Search ..... 473/151, 473/156, 219–222, 224, 225, 257, 261, 264, 473/265, 266

See application file for complete search history.

(56) References Cited

U.S. PATENT DOCUMENTS 3,009,704 A * 11/1961 Heard ..... 473/151
3,776,555 A * 12/1973 Hagaman ..... 473/221
3,801,108 A * 4/1974 Murray ..... 473/225
3,895,366 A 7/1975 Morris
4,903,968 A * 2/1990 Hargrave ..... 473/220
5,087,047 A 2/1992 McConnell
5,634,855 A 6/1997 King
6,261,189 B1 7/2001 Saville et al.
6,375,579 B1 4/2002 Hart
6,561,917 B2 5/2003 Manwaring

* cited by examiner

*Primary Examiner* — Nini Legesse
(74) *Attorney, Agent, or Firm* — Welsh Flaxman & Gitler LLC

(57) ABSTRACT

A golf training system includes a rearward and lower first laser beam defined by a rearward and lower first laser transmitting to a rearward and lower first receiving sensor with a first alarm. The golf training system also includes a forward and upper second laser beam defined by a forward and upper second laser transmitting to a forward and upper second receiving sensor, with a second alarm, located above the shoulder of the user. The first laser beam and the second laser beam are substantially parallel and define an extending ideal path along a designated club head path as a golfer swings. The extending ideal path corresponds to a desired club head path, if the club head crosses the first laser beam, the first alarm associated with the first receiving sensor is activated, and if the club head crosses the second laser beam, the second alarm associated with the second receiving sensor is activated.

18 Claims, 7 Drawing Sheets

GOLF TRAINING SYSTEM

CROSS REFERENCE TO RELATED APPLICATION

This application claims the benefit of U.S. Provisional Patent Application Ser. No. 61/291,708, entitled "GOLF TRAINING SYSTEM", filed Dec. 31, 2009.

BACKGROUND OF THE INVENTION

1. Field of the Invention

The invention relates to a golf training system. More particularly, the invention relates to a golf training system providing a golfer with a warning when his or her club head moves from a desired swing plane.

2. Description of the Related Art

If a golfer's club head is tracked throughout his or her swing, and the club head always travels in a single plane, that plane is called the golfer's "swing plane". The angle measured between the swing plane and the ground is the player's swing plane angle.

Golfers who swing their club head in the same swing plane on both their back and through swings (and that plane also contains their sternum, shoulders and the ball) are said to be swinging in what the inventors' believe is the "perfect" swing plane. Although most golfers address shots with their hands somewhat below their swing plane, the faster they swing and the more club head speed they generate on their down/through swing, the closer their hands come to moving up into the swing plane through impact.

Many golfers have two distinct swing planes. One swing plane is for their back swing. The swing then commonly changes to a different swing plane for their down/through swing. Either one (or neither) of these planes may be the "perfect" plane. Other golfers have no distinct planes in their swings at all, swinging in a constantly changing loop of directions. In general, the less complex or out-of-plane a golfer's club head path motion, the more consistent they will execute solid and repeatable swings, and the higher their percentage of solid golf shots will be.

As club length changes, it forces the swing plane angle of a golfer to change. In general, longer clubs require flatter (lower angle) swing planes, while shorter clubs require more upright (larger angle) swing plane angles for any given golfer. In practice, when golfers bend over too much (creating too flat a spine angle) the golfer can feel his or her body rotation being inhibited. Stand too tall (making the spine angle too vertical) and the golfers have trouble hitting solid shots, because his or her natural swing plane doesn't pass through the ball. If one has ever heard the term "perfect swing plane", it is the imaginary surface, often represented in drawings by a thick plane of glass that passes through a golfer's shoulders and the ball when he or she is at address. The club head should move in that plane throughout the swing.

As those skilled in the art will certainly appreciate, the development of an optimal swing plane is very important in achieving improvements in one's golf game and various attempts have been made to provide effective training tools. However, the prior devices are limited in their ability to effectively train a golfer. With this in mind, the present system for helping a golfer train his or her swing into the proper plane has been developed.

SUMMARY OF THE INVENTION

It is, therefore, an object of the present invention to provide a golf training system including a rearward and lower first laser beam defined by a rearward and lower first laser transmitting to a rearward and lower first receiving sensor with a first alarm. The golf training system also includes a forward and upper second laser beam defined by a forward and upper second laser transmitting to a forward and upper second receiving sensor, with a second alarm, located above the shoulder of the user. The first laser beam and the second laser beam are substantially parallel and define an extending ideal path along a designated club head path as a golfer swings. The extending ideal path corresponds to a desired club head path, if the club head crosses the first laser beam, the first alarm associated with the first receiving sensor is activated, and if the club head crosses the second laser beam, the second alarm associated with the second receiving sensor is activated.

It is also an object of the present invention to provide a golf training system wherein the first laser and the second laser are mounted upon a first stand.

It is another object of the present invention to provide a golf training system wherein the first stand includes a selectively collapsible tripod base, an upstanding post and a laser support bracket secured to the upstanding post.

It is a further object of the present invention to provide a golf training system wherein the laser support bracket is pivotally mounted in a manner permitting adjustment of the orientation of the first laser and the second laser.

It is also an object of the present invention to provide a golf training system wherein the upstanding post is telescopic permitting adjustment in the length of the upstanding post and height adjustment of the first laser and the second laser secured to the laser support bracket.

It is another object of the present invention to provide a golf training system wherein the laser support bracket is an elongated bar including a central portion pivotally secured to an upper end of the upstanding post via a selectively engageable compression knob for locking the elongated bar in desired orientations.

It is a further object of the present invention to provide a golf training system wherein the elongated bar also includes first and second members extending from the central portion, wherein the second laser is supported along the first member of the laser support bracket and the first laser is supported along the second member of the laser support bracket.

It is also an object of the present invention to provide a golf training system wherein each of the first member and the second member includes an elongated slot in which the first and second lasers are respectively mounted for selective movement along the length of the laser support bracket.

It is another object of the present invention to provide a golf training system wherein the first receiving sensor and the second receiving sensor are mounted upon a second stand.

It is a further object of the present invention to provide a golf training system wherein the second stand includes a selectively collapsible tripod base, an upstanding post and a sensor support bracket secured to the upstanding post and the first stand includes a selectively collapsible tripod base, an upstanding post and a laser support bracket secured to the upstanding post.

It is also an object of the present invention to provide a golf training system wherein the sensor support bracket is pivotally mounted in a manner permitting adjustment of the orientation of the first receiving sensor and the second receiving sensor and the laser support bracket is pivotally mounted in a manner permitting adjustment of the orientation of the first laser and the second laser.

It is a further object of the present invention to provide a golf training system wherein the upstanding post is telescopic permitting adjustment in the length of the upstanding post and height adjustment of the first receiving sensor and the second receiving sensor secured to the sensor support bracket and the upstanding post is telescopic permitting adjustment in the length of the upstanding post and height adjustment of the first laser and the second laser secured to the laser support bracket.

It is also an object of the present invention to provide a golf training system wherein the sensor support bracket is an elongated bar including a central portion pivotally secured to an upper end of the upstanding post via a selectively engageable compression knob for locking the elongated bar in desired orientations and the laser support bracket is an elongated bar including a central portion pivotally secured to an upper end of the upstanding post via a selectively engageable compression knob for locking the elongated bar in desired orientations.

It is another object of the present invention to provide a golf training system wherein the elongated bar also includes first and second members extending from the central portion, wherein the second receiving sensor is supported along the first member of the sensor support bracket and the first receiving sensor is supported along the second member of the sensor support bracket and the elongated bar also includes first and second members extending from the central portion, wherein the second laser is supported along the first member of the laser support bracket and the first laser is supported along the second member of the laser support bracket.

It is a further object of the present invention to provide a golf training system wherein each of the first member and the second member includes an elongated slot in which the first and second receiving sensors are respectively mounted for selective movement along the length of the laser support bracket and each of the first member and the second member includes an elongated slot in which the first and second lasers are respectively mounted for selective movement along the length of the laser support bracket.

It is also an object of the present invention to provide a golf training system wherein the first receiving sensor and the second receiving sensor are mounted upon a practice mat.

It is another object of the present invention to provide a golf training system wherein the first sensor are positioned approximately six inches apart.

It is a further object of the present invention to provide a golf training system wherein the first receiving sensor and the second receiving sensor are recessed within the practice mat.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 9 is a rear perspective view of the golf training system shown in FIG. 7 oriented for training a golfer's follow through.

DESCRIPTION OF THE PREFERRED EMBODIMENT

Figure 1:
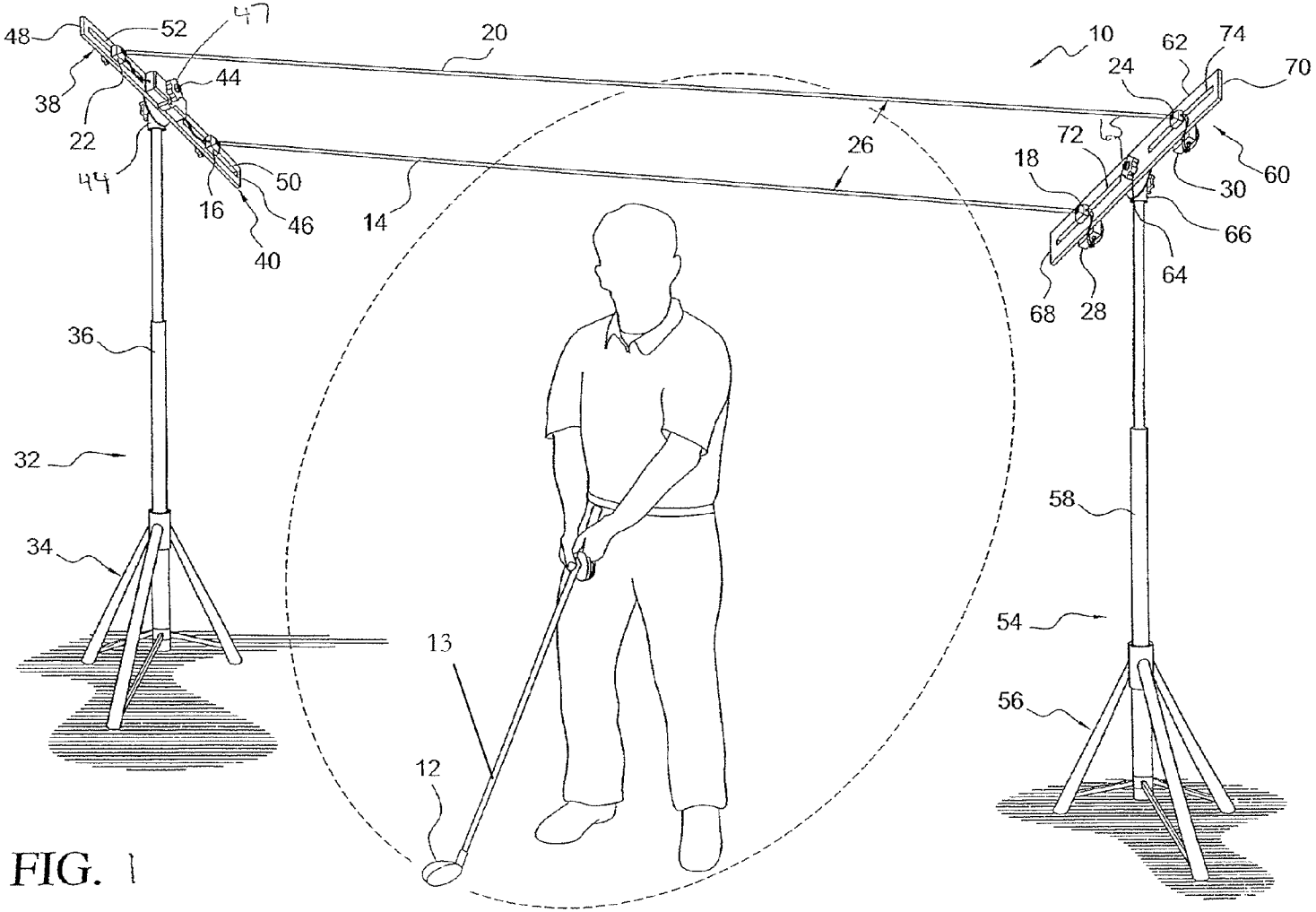
FIG. 1 is a side perspective view of the golf training system in use.
Figure 2:
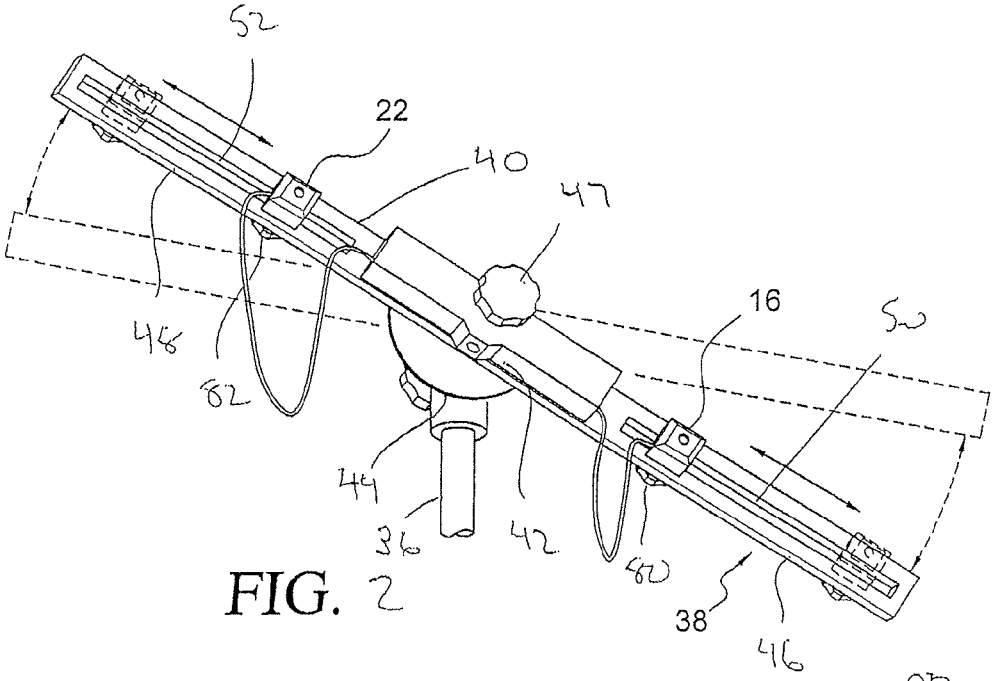
FIG. 2 is a detailed perspective view of the first and second lasers.
Figure 3:
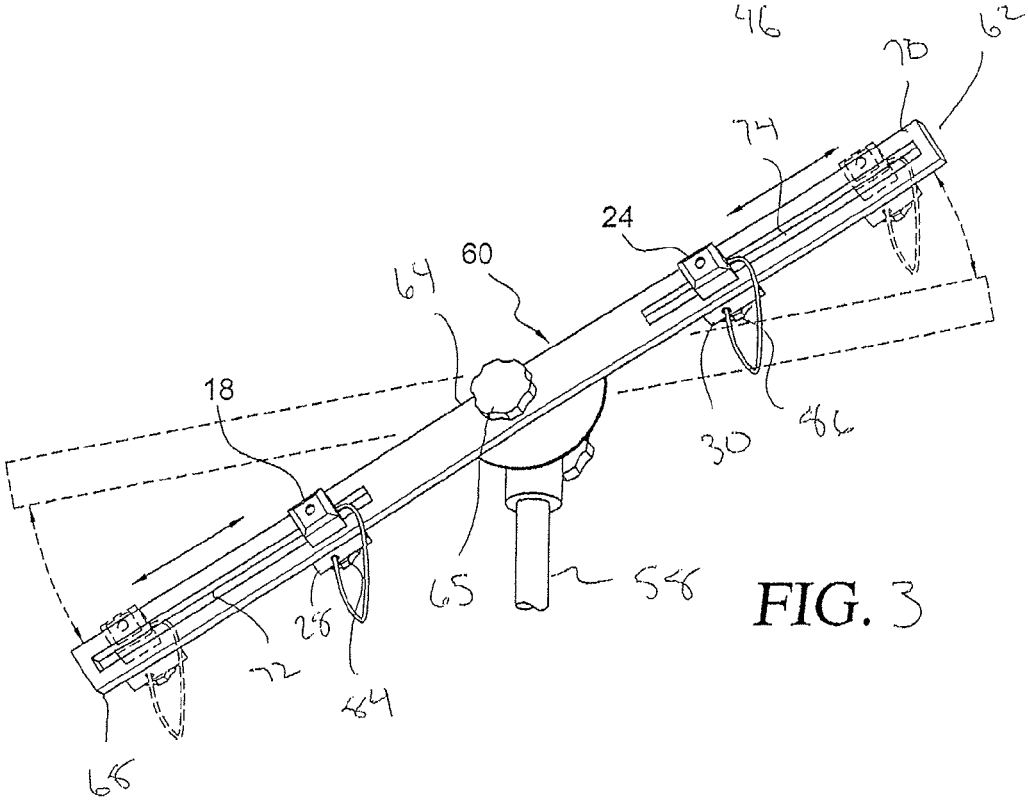
FIG. 3 is a detailed perspective view of the first and second receiving sensors.
Figure 4:
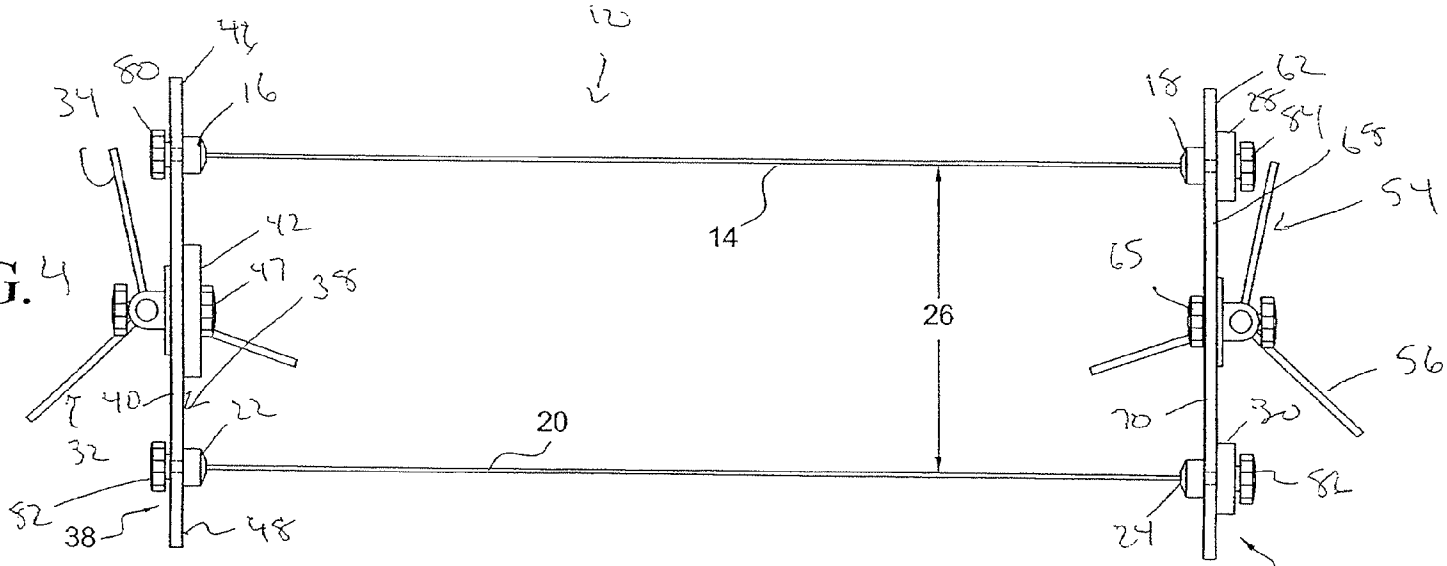
FIG. 4 is a top view of the golf training system.
Figure 5:
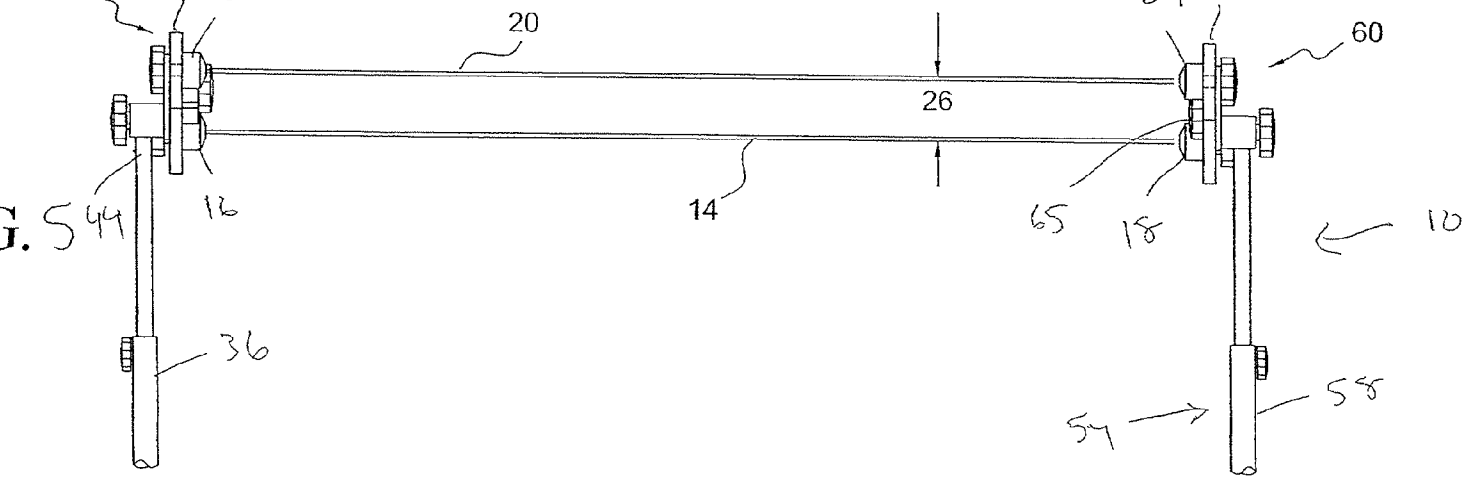
FIG. 5 is a side view of the golf training system.
Figure 6:
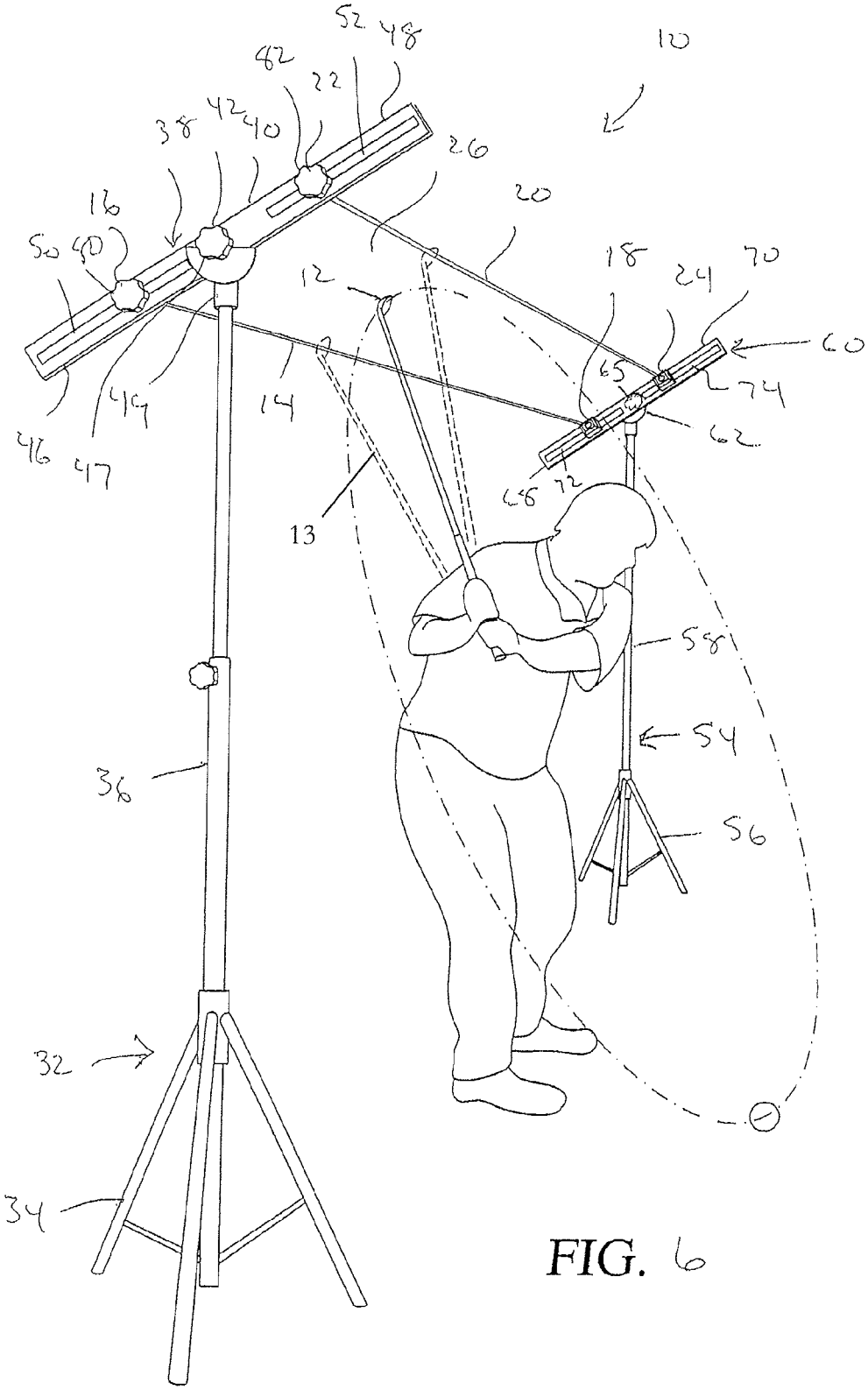
FIG. 6 is a rear perspective view of the golf training system in use.

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as the basis for the claims and as a basis for teaching one skilled in the art how to make and/or use the invention.

In accordance with the present invention, and with reference to FIGS. 1 to 6, a golf training system 10 is disclosed for providing a golfer with an indication the club head 12 being swung is maintained in a proper plane as he or she completes a golf swing. Briefly, the training system 10 includes a rearward and lower first laser beam 14 defined by a rearward and lower first laser 16 transmitting to a rearward and lower first receiving sensor 18 and a forward and upper second laser beam 20 defined by a forward and upper second laser 22 transmitting to a forward and upper second receiving sensor 24 located above the shoulder of the user. The positional terms used herein are intended to refer to the relative positions of the components as they relate to the golfer using the present system. In particular, "rearward and lower" refers to a position further from the back of the golfer along a vertical plane and closer to the ground, while "forward and upper" refers to a position closer to the back of the golfer along a vertical plane and further from the ground than the "rearward and lower" component.

The first laser beam 14 and the second laser beam 20 are substantially parallel and define an extending ideal path 26 positioned above the shoulders of a golfer and along a designated club head path as a golfer swings. The extending ideal path 26 is positioned behind and above the golfer's shoulders and is intended to correspond to a desired club head path as it moves through the top of a golfer's swing. If the club head 12 or shaft 13 crosses the first laser beam 14, a first alarm 28, associated with the first receiving sensor 18, is activated. If the club head 12 or shaft 13 crosses the second laser beam 20, a second alarm 30, associated with the second receiving sensor 24 and different from the first alarm 28, is activated.

More particularly, the first and second lasers 16, 22 are mounted upon a first stand 32. The first stand 32 includes a selectively collapsible tripod base 34, an upstanding post 36 and a laser support bracket 38 secured to the upstanding post 36. As will be better appreciated based upon the following disclosure, the laser support bracket 38 is pivotally mounted in a manner permitting adjustment of the orientation of the first and second lasers 16, 22 to suit different golfers. Adjustment is further facilitated by the telescopic construction of the upstanding post 36 in a manner permitting adjustment in the length of the upstanding post 36 and ultimately height adjustment of the first and second lasers 16, 22 secured to the laser support bracket 38.

In accordance with a preferred embodiment of the present invention, the laser support bracket 38 is an elongated bar 40 including a central portion 42 pivotally secured to the upper end 44 of the upstanding post 36 via a selectively engageable compression knob 47 for locking the elongated bar 40 in desired orientations. The elongated bar 40 also includes first and second members 46, 48 extending from the central portion 42 to define the present laser support bracket 38 that is capable of supporting the second laser 22 along the first member 46 of the laser support bracket 38 and the first laser 16 along the second member 48 of the laser support bracket 38. Each of the first member 46 and the second member 48 includes an elongated slot 50, 52 in which the first and second lasers 16, 22 are respectively mounted for selective movement along the length of the laser support bracket 38. Selective movement along the slots 50, 52 is controlled by the provision of selectively engageable compression knobs 80, 82 for the first and second lasers 16, 22. As a result of the compression knobs 47, 80, 82, and as will be better appreciated based upon the following disclosure relating to the use of the present invention, the relative position of the second laser 22 and/or the first laser 16 may be changed to suit the swings of different golfers.

As with the first stand 32, a second stand 54 is provided for supporting the second receiving sensor 24 and the first receiving sensor 18. The second stand 54 is substantially identical to that used in conjunction with the first and second lasers 16, 22, and includes a selectively collapsible tripod base 56, an upstanding post 58 and a sensor support bracket 60 secured to the upstanding post 58. The sensor support bracket 60 is pivotally mounted in a manner permitting adjustment of the first and second receiving sensors 18, 24 orientations to suit different golfers. Adjustment is further facilitated by the telescopic construction of the upstanding post 58 in a manner permitting adjustment in the length of the upstanding post 58 and ultimately height adjustment of the first and second receiving sensors 18, 24 secured to the sensor support bracket 60.

In accordance with a preferred embodiment of the present invention, the sensor support bracket 60 is an elongated bar 62 including a central portion 64 pivotally secured to the upper end 66 of the upstanding post 58 via a selectively engageable compression knob 65 for locking the elongated bar 62 in desired orientations. The elongated bar 62 also includes first and second members 68, 70 extending from the central portion 64 to define the sensor support bracket 60 capable of supporting the second receiving sensor 24 along the first member 68 of the sensor support bracket 60 and the lower first receiving sensor 18 along the second member 70 of the sensor support bracket 60. Each of the first member 68 and the second member 70 includes an elongated slot 72, 74 in which the first or second receiving sensor 18, 24 is mounted for selective movement along the length of the sensor support bracket 60. Selective movement along the slots 72, 74 is controlled by the provision of selectively engageable compression knobs 84, 86 for the first or second receiving sensor 18, 24. As a result of the compression knobs 65, 84, 86, and as will be better appreciated based upon the following disclosure relating to the use of the present invention, the relative position of the second receiving sensor 24 and/or the first receiving sensor 18 may be changed to suit the swings of different golfers.

The first and second alarms 28, 30 are respectively linked to the first receiving sensor 18 and the second receiving sensor 24 such that the first alarm 28 is activated when a golfer's club head 12 or shaft 13 breaks the first laser beam 14 and the second alarm 30 is activated when a golfer's club head 12 or shaft 13 breaks the forward and upper second laser beam 20. The first alarm 28 and the second alarm 30 are different in the way they sound providing the golfer with a clear indication as to whether the golfer has broken the first or second laser beam 14, 20.

In practice, the first stand 32 and the second stand 54 are positioned slightly behind the shoulders of the golfer along a line substantially parallel to the golfer's shoulders, that is, along a line extending between the shoulders of the golfer. The first and second lasers 16, 22 of the first stand 32 are then aligned with the first receiving sensor 18 and the second receiving sensor 24 of the second stand 54 such that first and second laser beams 14, 20 extend between the respective first and second stands 32, 54. The upper second laser beam 20 and lower first laser beam 14 are substantially parallel and are oriented to define an ideal path 26 through which a golfer should move his club head 12 as he or she arcs the club head 12 through a swing plane extending above the shoulders of the golfer.

As will be appreciated, each golfer has a different swing plane depending upon the physical make-up of the golfer. As such, it is necessary to adjust the ideal path 26 defined by the first and second laser beams 14, 20 to accommodate various golfers. This is achieved by rotating the sensor support bracket 60 and the laser support bracket 38, as well as adjusting the respective first and second receiving sensors 18, 24 and the first and second lasers 16, 22 along the respective sensor support bracket 60 and the laser support bracket 38.

By utilizing the present invention and understanding the concepts of swing plane as discussed above, a golfer receives instant feedback which may be used to adjust his or her swing in an effort to optimize his or her swing plane for producing a more consistent golf swing which will ultimately result in lower scores.

Figure 7:
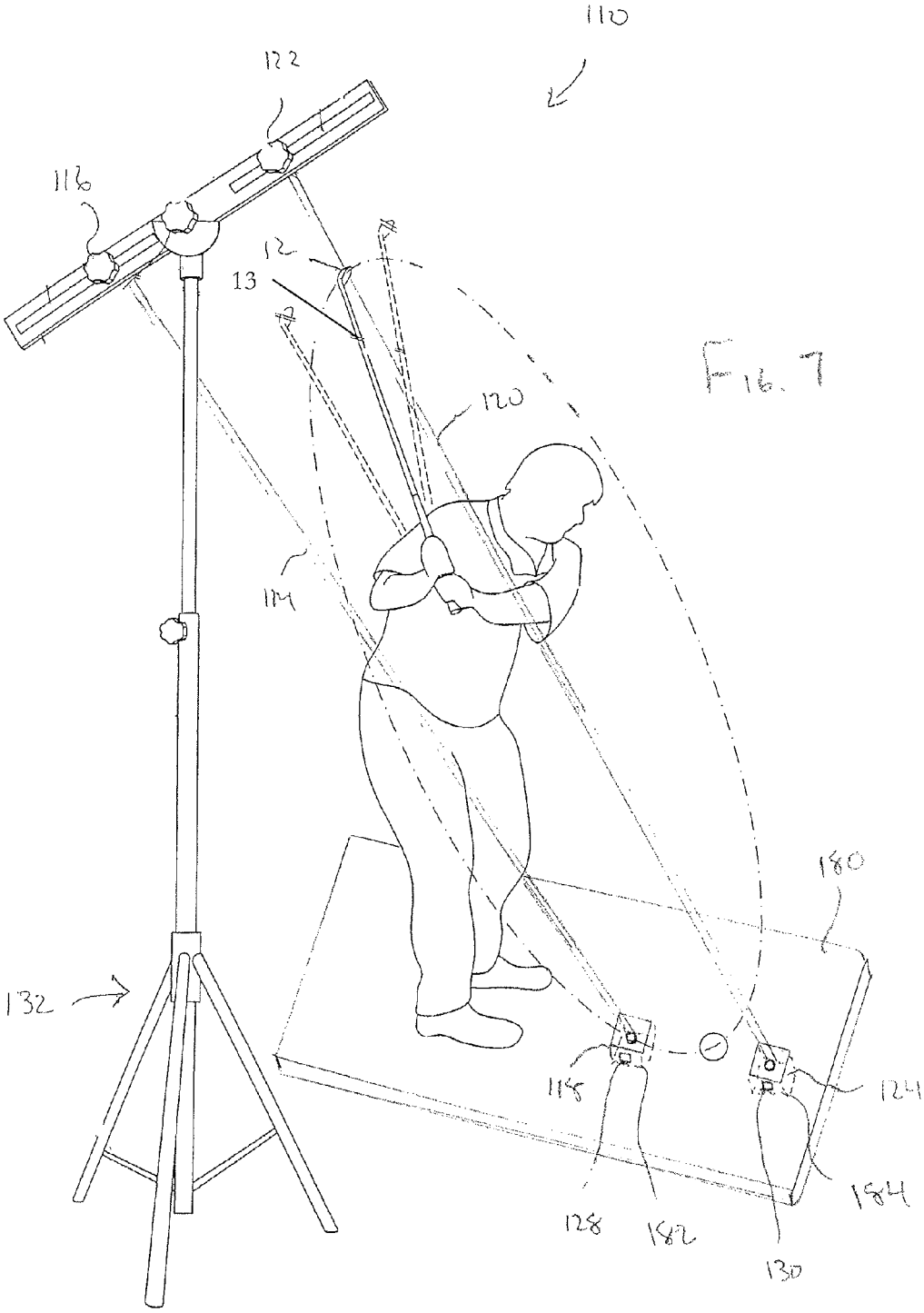
FIG. 7 is a rear perspective view of the golf training system in accordance with an alternate embodiment wherein the backswing of a golfer is monitored.

An alternate use of the present technology as shown with reference to FIG. 7 involves the removal the second stand 54, that is, the removal of the second receiving sensor 24 and the first receiving sensor 18. With the second stand 54 removed, second receiving sensor 24 and the first receiving sensor 18 are placed within a practice synthetic mat on either side of the golf ball. This allows the golfer's "take-away" and "downswing" to be within the laser beams 114, 120 with no regard for the golfer's "follow-through."

Figure 8:
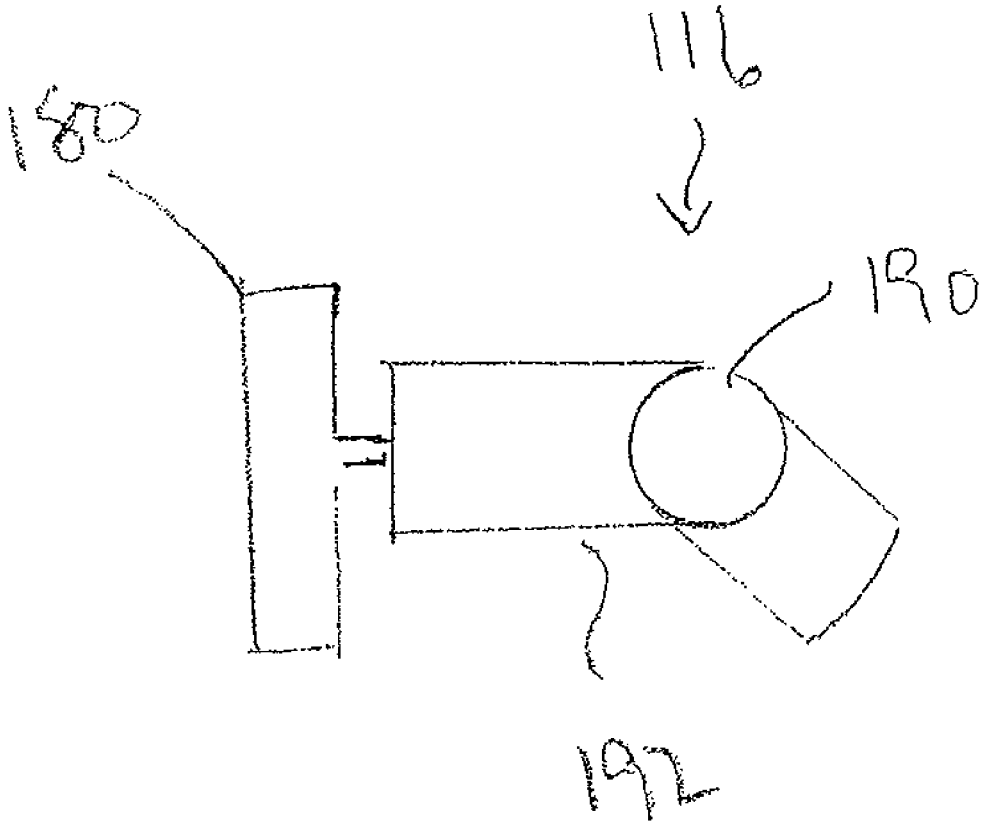
FIG. 8 is a side view of an articulating laser in accordance with the embodiment disclosed with reference to FIG. 7.
Figure 9:
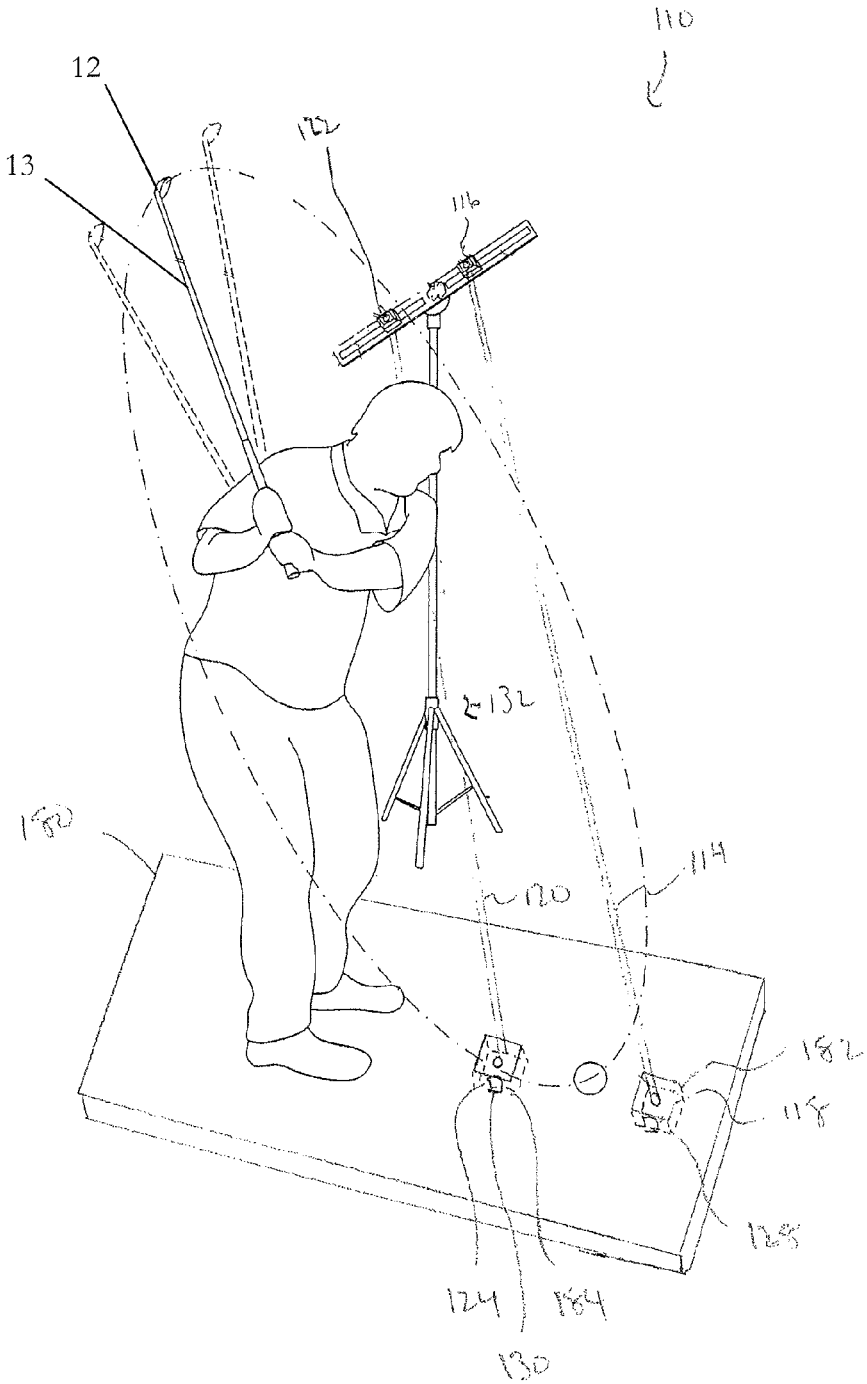

More particularly, the first stand 132 is substantially the same as discussed above although the first and second lasers 116, 122 are focused downwardly toward first and second receiving sensors 118, 124 located within the practice mat 180 upon which the golfer stands while practicing in accordance with the present invention. With this in mind, and with reference to FIG. 8, the first and second lasers 116, 122 (only first laser 116 is shown in FIG. 8 although it is appreciated the first and second lasers are identical) are provided with a pivotal adjustment mechanism 190 associated with the housing 192 thereof to allow for focusing downwardly so as to engage the respective first and second receiving sensors 118, 124.

With this arrangement the first and second laser beams 114, 120 are created defining the plane in which the golf club head 12 should be in while the golfer takes the club head 12 away from the ball during the initial part of the golf swing and returns the golf club head 12 therethrough during the downswing.

The first stand 132, and the associated first and second lasers 116, 122 are the same as those disclosed with reference to the prior embodiment disclosed in FIGS. 1 to 6. However, the second stand, and associated first and second receiving sensors 118, 124, are replaced with first and second receiving sensors 118, 124 mounted within recesses 182, 184 formed in the practice mat 180. In accordance with a preferred embodiment, the first and second receiving sensors 118, 124 are positioned on opposite sides of the golf ball with the first and second receiving sensors 118, 124 spaced approximately 6 inches apart. The first and second receiving sensors 118, 124 are preferably recessed with the mat 180 approximately ⅛ inch to avoid any interference with the golf club as the golfer swings during his or her practice sessions.

As with the sensors described above, the first and second receiving sensors 118, 124 are associated with first and second alarms 128, 130 such that the first alarm 128 is activated when a golfer's club head 12 breaks the first laser beam 114 and the second alarm 130 is activated when a golfer's club head 12 or shaft 13 breaks the forward and upper second laser beam 120. The first alarm 128 and the second alarm 130 are different in the way they sound providing the golfer with a clear indication as to whether the golfer has broken the first or second laser beam 114, 120.

In practice, the first stand 132 is positioned slightly behind the shoulders of the golfer along a line substantially parallel to the golfer's shoulders, that is, along a line extending between the shoulders of the golfer. The first stand 132 is positioned in the direction of the golfer's backswing, that is, to the right of a right handed golfer. The first and second lasers 116, 122 of the first stand 132 are then aligned with the first receiving sensor 118 and the second receiving sensor 124 mounted within the practice mat such that first and second laser beams 114, 120 extend between the respective first stand 132 and the first and second receiving sensor 118, 124. The upper second laser beam 120 and lower first laser beam 114 are substantially parallel and are oriented to define an ideal path 126 through which a golfer should move his club head 12 as he or she begins the backswing and completes the downswing through an ideal swing plane.

As with the prior embodiment, each golfer has a different swing plane depending upon the physical make-up of the golfer. As such, it is necessary to adjust the ideal path 126 defined by the first and second laser beams 114,120 to accommodate various golfers. This is achieved by applying the various adjustment features built into the present system.

The single stand embodiment shown in FIG. 7 may be employed in training a golfer through his or her follow through as shown with reference to FIG. 8. In accordance with this variation, the first stand 132 is positioned to the left of the right handed golfer. The first stand 132 is substantially the same as discussed above although the first and second lasers 116, 122 are focused downwardly toward first and second receiving sensors 118, 124 located within the practice mat 180 upon which the golfer stands while practicing in accordance with the present invention. With this arrangement first and second laser beams 114, 120 are created defining the plane in which the golf club should be in while the golfer follows through during his or her golf swing.

In practice, the first stand 132 is positioned slightly behind the shoulders of the golfer along a line substantially parallel to the golfer's shoulders, that is, along a line extending between the shoulders of the golfer. The first stand 132 is positioned in the direction of the golfer's follow through, that is, to the left of a right handed golfer. The first and second lasers 116, 122 of the first stand 132 are then aligned with the first receiving sensor 118 and the second receiving sensor 124 mounted within the practice mat such that first and second laser beams 114, 120 extend between the respective first stand 132 and the first and second receiving sensors 118, 124. The upper second laser beam 120 and lower first laser beam 114 are substantially parallel and are oriented to define an ideal path 126 through which a golfer should move his club head 12 as he or she finishes the golf swing during the follow through.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A golf training system, comprising:

a rearward and lower first laser beam defined by a rearward and lower first laser transmitting to a rearward and lower first receiving sensor with a first alarm;

a forward and upper second laser beam defined by a forward and upper second laser transmitting to a forward and upper second receiving sensor, with a second alarm, located above a shoulder of a user;

the first laser, the first receiving sensor, the second laser and the second receiving sensor are mounted upon first and second pivotally adjustable support brackets supporting the first laser, the first receiving sensor, the second laser and the second receiving sensor such that the first laser beam and the second laser beam are substantially parallel and define an extending ideal path along a designated club head path as a golfer swings;

wherein the extending ideal path corresponds to a desired club head path, if a club head crosses the first laser beam, the first alarm associated with the first receiving sensor is activated, and if the club head crosses the second laser beam, the second alarm associated with the second receiving sensor is activated.

2. The golf training system according to claim 1, wherein the first laser and the second laser are mounted upon a first stand.

3. The golf training system according to claim 2, wherein the first stand includes a selectively collapsible tripod base, an upstanding post and the first pivotally adjustable support bracket secured to the upstanding post, and the first laser and the second laser being mounted on the first pivotally adjustable support bracket.

4. The golf training system according to claim 3, wherein the first pivotally adjustable support bracket is pivotally mounted in a manner permitting adjustment of the orientation of the first laser and the second laser.

5. The golf training system according to claim 4, wherein the upstanding post of the first stand is telescopic permitting adjustment in the length of the upstanding post and height adjustment of the first laser and the second laser secured to the first pivotally adjustable support bracket.

6. The golf training system according to claim 2, wherein the first receiving sensor and the second receiving sensor are mounted upon a second stand.

7. The golf training system according to claim 6, wherein the second stand includes a selectively collapsible tripod base, an upstanding post and the second support bracket secured to the upstanding post, the first receiving sensor and the second receiving sensor being mounted on the second support bracket, and the first stand includes a selectively collapsible tripod base, an upstanding post and the second support bracket secured to the upstanding post, the first laser and the second laser being mounted on the first support bracket.

8. The golf training system according to claim 2, wherein the first receiving sensor and the second receiving sensor are mounted upon a practice mat.

9. The golf training system according to claim 8, wherein the first sensor are positioned approximately six inches apart.

10. A golf training system, comprising:

a rearward and lower first laser beam defined by a rearward and lower first laser transmitting to a rearward and lower first receiving sensor with a first alarm;

a forward and upper second laser beam defined by a forward and upper second laser transmitting to a forward and upper second receiving sensor, with a second alarm, located above a shoulder of a user;

the first laser beam and the second laser beam are substantially parallel and define an extending ideal path along a designated club head path as a golfer swings;

wherein the extending ideal path corresponds to a desired club head path, if a club head crosses the first laser beam, the first alarm associated with the first receiving sensor is activated, and if the club head crosses the second laser beam, the second alarm associated with the second receiving sensor is activated;

wherein the first laser and the second laser are mounted upon a first stand including a selectively collapsible tripod base, an upstanding post and a laser support bracket secured to the upstanding post, the laser support bracket is an elongated bar including a central portion pivotally secured to an upper end of the upstanding post of the first stand via a selectively engageable compression knob for locking the elongated bar in desired orientations.

11. The golf training system according to claim 10, wherein the elongated bar also includes first and second members extending from the central portion, wherein the second laser is supported along the first member of the laser support bracket and the first laser is supported along the second member of the laser support bracket.

12. The golf training system according to claim 11, wherein each of the first member and the second member includes an elongated slot in which the first and second lasers are respectively mounted for selective movement along the length of the laser support bracket.

13. A golf training system comprising:

a rearward and lower first laser beam defined by a rearward and lower first laser transmitting to a rearward and lower first receiving sensor with a first alarm;

a forward and upper second laser beam defined by a forward and upper second laser transmitting to a forward and upper second receiving sensor, with a second alarm, located above a shoulder of a user;

the first laser beam and the second laser beam are substantially parallel and define an extending ideal path along a designated club head path as a golfer swings;

wherein the extending ideal path corresponds to a desired club head path, if a club head crosses the first laser beam, the first alarm associated with the first receiving sensor is activated, and if the club head crosses the second laser beam, the second alarm associated with the second receiving sensor is activated;

wherein the first laser and the second laser are mounted upon a first stand and the first receiving sensor and the second receiving sensor are mounted upon a second stand, and the second stand includes a selectively collapsible tripod base, an upstanding post and a sensor support bracket secured to the upstanding post and the first stand includes a selectively collapsible tripod base, an upstanding post and a laser support bracket secured to the upstanding post, and wherein the sensor support bracket is pivotally mounted in a manner permitting adjustment of the orientation of the first receiving sensor and the second receiving sensor and the laser support bracket is pivotally mounted in a manner permitting adjustment of the orientation of the first laser and the second laser.

14. The golf training system according to claim 13, wherein the upstanding post of the second stand is telescopic permitting adjustment in the length of the upstanding post of the second stand and height adjustment of the first receiving sensor and the second receiving sensor secured to the sensor support bracket and the upstanding post of the first stand is telescopic permitting adjustment in the length of the upstanding post of the first stand and height adjustment of the first laser and the second laser secured to the laser support bracket.

15. A golf training system, comprising:

a rearward and lower first laser beam defined by a rearward and lower first laser transmitting to a rearward and lower first receiving sensor with a first alarm;

a forward and upper second laser beam defined by a forward and upper second laser transmitting to a forward and upper second receiving sensor, with a second alarm, located above a shoulder of a user;

the first laser beam and the second laser beam are substantially parallel and define an extending ideal path along a designated club head path as a golfer swings;

wherein the extending ideal path corresponds to a desired club head path, if a club head crosses the first laser beam, the first alarm associated with the first receiving sensor is activated, and if the club head crosses the second laser beam, the second alarm associated with the second receiving sensor is activated;

wherein the first laser and the second laser are mounted upon a first stand and the first receiving sensor and the second receiving sensor are mounted upon a second stand, and the second stand includes a selectively collapsible tripod base, an upstanding post and a sensor support bracket secured to the upstanding post and the first stand includes a selectively collapsible tripod base, an upstanding post and a laser support bracket secured to the upstanding post, and the sensor support bracket is an elongated bar including a central portion pivotally secured to an upper end of the upstanding post of the second stand via a selectively engageable compression knob for locking the elongated bar in desired orientations and the laser support bracket is an elongated bar including a central portion pivotally secured to an upper end of the upstanding post of the first stand via a selectively engageable compression knob for locking the elongated bar of the laser support bracket in desired orientations.

16. The golf training system according to claim 15, wherein the elongated bar of the sensor support bracket also includes first and second members extending from the central portion, wherein the second receiving sensor is supported along the first member of the sensor support bracket and the first receiving sensor is supported along the second member of the sensor support bracket and the elongated bar of the laser support bracket also includes first and second members extending from the central portion, wherein the second laser is supported along the first member of the laser support bracket and the first laser is supported along the second member of the laser support bracket.

17. The golf training system according to claim 16, wherein each of the first member and the second member of the elongated bar of the sensor support bracket includes an elongated slot in which the first and second receiving sensors are respectively mounted for selective movement along the length of the laser support bracket and each of the first member and the second member of the elongated bar of the laser support bracket includes an elongated slot in which the first and second lasers are respectively mounted for selective movement along the length of the laser support bracket.

18. A golf training system, comprising:

a rearward and lower first laser beam defined by a rearward and lower first laser transmitting to a rearward and lower first receiving sensor with a first alarm;

a forward and upper second laser beam defined by a forward and upper second laser transmitting to a forward and upper second receiving sensor, with a second alarm, located above a shoulder of a user;

the first laser beam and the second laser beam are substantially parallel and define an extending ideal path along a designated club head path as a golfer swings;

wherein the extending ideal path corresponds to a desired club head path, if a club head crosses the first laser beam, the first alarm associated with the first receiving sensor is activated, and if the club head crosses the second laser beam, the second alarm associated with the second receiving sensor is activated;

wherein the first laser and the second laser are mounted upon a first stand and the first receiving sensor and the second receiving sensor are mounted upon a practice mat, and the first receiving sensor and the second receiving sensor are recessed within the practice mat.

* * * * *